US007125322B1

(12) United States Patent
Champaigne

(10) Patent No.: US 7,125,322 B1
(45) Date of Patent: Oct. 24, 2006

(54) MEDIA TRANSPORT DEVICE PROVIDING STABLE FLOW OF MEDIA

(75) Inventor: Jack Champaigne, Mishawaka, IN (US)

(73) Assignee: Electronics, Inc., Mishawaka, IN (US)

( * ) Notice: Subject to any disclaimer, the term of this patent is extended or adjusted under 35 U.S.C. 154(b) by 0 days.

(21) Appl. No.: 11/228,175

(22) Filed: Sep. 16, 2005

Related U.S. Application Data

(60) Provisional application No. 60/611,146, filed on Sep. 17, 2004.

(51) Int. Cl.
*B24C 5/00* (2006.01)
*B24C 7/00* (2006.01)

(52) U.S. Cl. ..... 451/89; 451/91; 451/99

(58) Field of Classification Search ..... 451/75, 451/89, 90, 91, 92, 99, 102
See application file for complete search history.

(56) References Cited

U.S. PATENT DOCUMENTS 5,036,631 A * 8/1991 Stoltz ..... 451/102
5,616,067 A * 4/1997 Goenka ..... 451/39
5,785,582 A * 7/1998 Stefanik et al. ..... 451/102
6,077,152 A * 6/2000 Warehime ..... 451/75
6,186,422 B1 * 2/2001 Hubner et al. ..... 239/589
2003/0037654 A1 * 2/2003 Sciulli et al. ..... 83/177
2006/0035570 A1 * 2/2006 Chisum et al. ..... 451/99

* cited by examiner

*Primary Examiner*—Jacob K. Ackun, Jr.
(74) *Attorney, Agent, or Firm*—Botkin & Hall, LLP

(57) ABSTRACT

A media transport device for use in shot peening, blast cleaning, granite cutting, and similar applications transports media from a storage hopper to a workpiece. The media transport device includes a source of compressed air, a supply hose connecting the compressed air source to a mixing chamber, and a blast hose connecting the mixing chamber to a nozzle dispensing the media onto a workpiece. The mixing chamber defines a flow path for the compressed air between the supply hose and the blast hose and includes an inlet portion connected to the supply hose, an outlet portion connected to the blast hose, and a curved dispensing portion conveying media from the storage hopper into the flow path obliquely with respect to the flow path so that laminar flow through the mixing chamber is not substantially disturbed. The inlet portion is of sufficient length to assure laminar flow of compressed air through the mixing changer before the media is introduced into the flow stream, and the outlet portion includes a section tapering to a diameter substantially equal to the inner diameter of the blast hose.

16 Claims, 4 Drawing Sheets

MEDIA TRANSPORT DEVICE PROVIDING STABLE FLOW OF MEDIA

CROSS REFERENCE TO A RELATED APPLICATION

This application claims domestic priority based upon U.S. Provisional Patent Application Ser. No. 60/611,146, filed Sep. 17, 2004.

TECHNICAL FIELD

This invention relates to improving the flow of media in media transport equipment used in shot peening, blast cleaning, granite cutting and similar applications.

BACKGROUND OF THE INVENTION

Iron or steel granules, also called shot or grit, are used in abrasive blast cleaning, granite cutting, shot peening and other applications. The efficiency of the process of applying the media to the workpiece is a function of the continuity of media flow through the media transporting equipment and impacting upon the workpiece being treated. One common type of media transport equipment uses compressed air to transport the media. A supply hose connects a compressed air source to a mixing chamber (generally a conventional plumbing tee), and a blast hose communicates the mixing chamber to a dispensing nozzle. The tee is connected to the supply and blast hoses by relatively short, conventional plumbing nipples. Media is dropped from a storage hopper into the top stem of the tee, through which the media drops into the air stream communicating through the tee from the compressed air source. Installation of the plumbing tee between the supply and blast hoses results in several abrupt changes in diameter of the flow path, thereby causing turbulent flow and the resulting discontinuities in the flow of the media. Abruptly dropping the media into the flow stream further contributes to the flow discontinuities.

SUMMARY OF THE INVENTION

According to the invention, a media transport device for transporting media from a storage hopper to a workpiece includes a source of compressed air, a supply hose connecting the compressed air source to a mixing chamber, and a blast hose connecting the mixing chamber to a nozzle dispensing the media onto a workpiece. The mixing chamber defines a flow path for the compressed air between the supply hose and the blast hose and includes an inlet portion connected to the supply hose, an outlet portion connected to the blast hose, and a curved dispensing portion conveying media from the storage hopper into the flow path obliquely with respect to the flow path so that laminar flow through the mixing chamber is not substantially disturbed. The inlet portion is of sufficient length to assure laminar flow of compressed air through the mixing changer before the media is introduced into the flow stream, and the outlet portion includes a section tapering to a diameter substantially equal to the inner diameter of the blast hose.

DESCRIPTION OF THE PREFERRED EMBODIMENT

Figure 1:
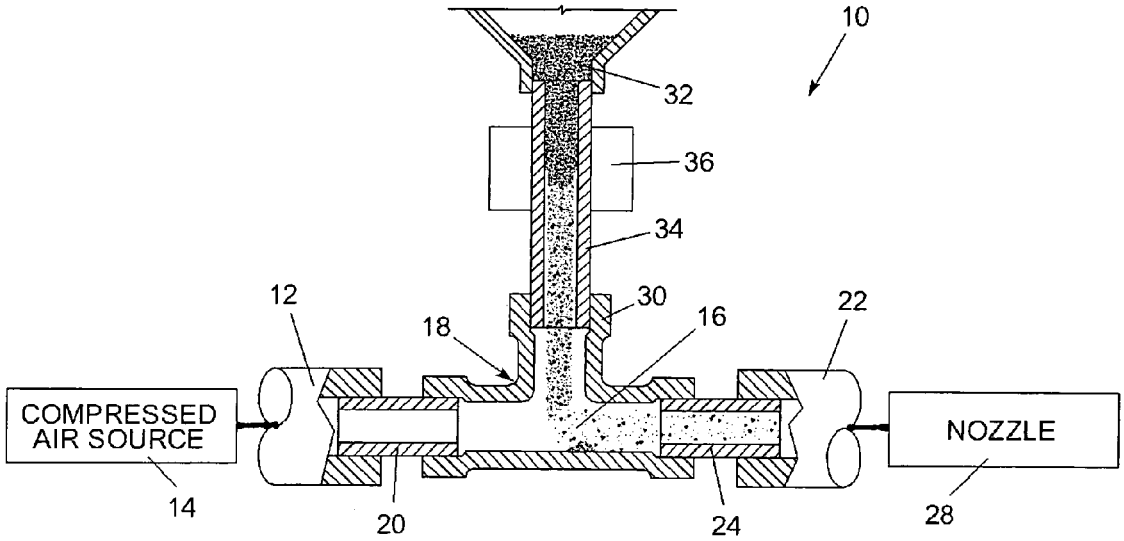
FIGURE 1 PRIOR ART
FIG. 1 is a cross sectional view of a prior art device.

Referring now to FIG. 1 of the drawings, a media transport device for conveying media (such as shot or grit) for application to a workpiece is generally indicated by the numeral 10. The device 10 is used in shot peening, blast cleaning, granite cutting and similar applications where compressed air is used to transport the media. Device 10 includes a supply hose 12 which communicates a compressed air source 14 to a mixing chamber generally indicated by a numeral 16. The prior art mixing chamber 16 includes a conventional plumbing tee 18 which is connected to supply hose 12 by a conventional nipple 20 and to a blast hose 22 by a nipple 24 similar to nipple 20. The blast hose 22 communicates with a nozzle 28, which applies the media to a workpiece (not shown). The media is introduced into the air stream through vertical stem 30 of the tee 18, which communicates with storage hopper 32 through passage 34 and through a conventional flow control device, such as a magnetic control valve, generally indicated by the numeral 36. The control valve regulates the quantity of the media dispensed into the mixing chamber 16.

Accordingly, because of the connections between the hoses 12,26 and their corresponding nipples 20,24 and because of the connections between the nipples and the tee 18, many changes in diameter in the flow path through the mixing chamber are present, with only short lengths of flow path between the changes in diameter. Due to the changes in diameter, turbulent flow is established, and due to the short lengths of the flow path between the changes in diameter, turbulent flow is maintained within the mixing chamber, resulting in discontinuities in flow, which are propagated into and through the blast hose 26. Accordingly, media is inconsistently applied to the workpiece. Furthermore, the media is dropped vertically into the flow stream, which also maintains turbulence in the flow and results in inconsistent mixing of media into the flow stream.

Figure 2:
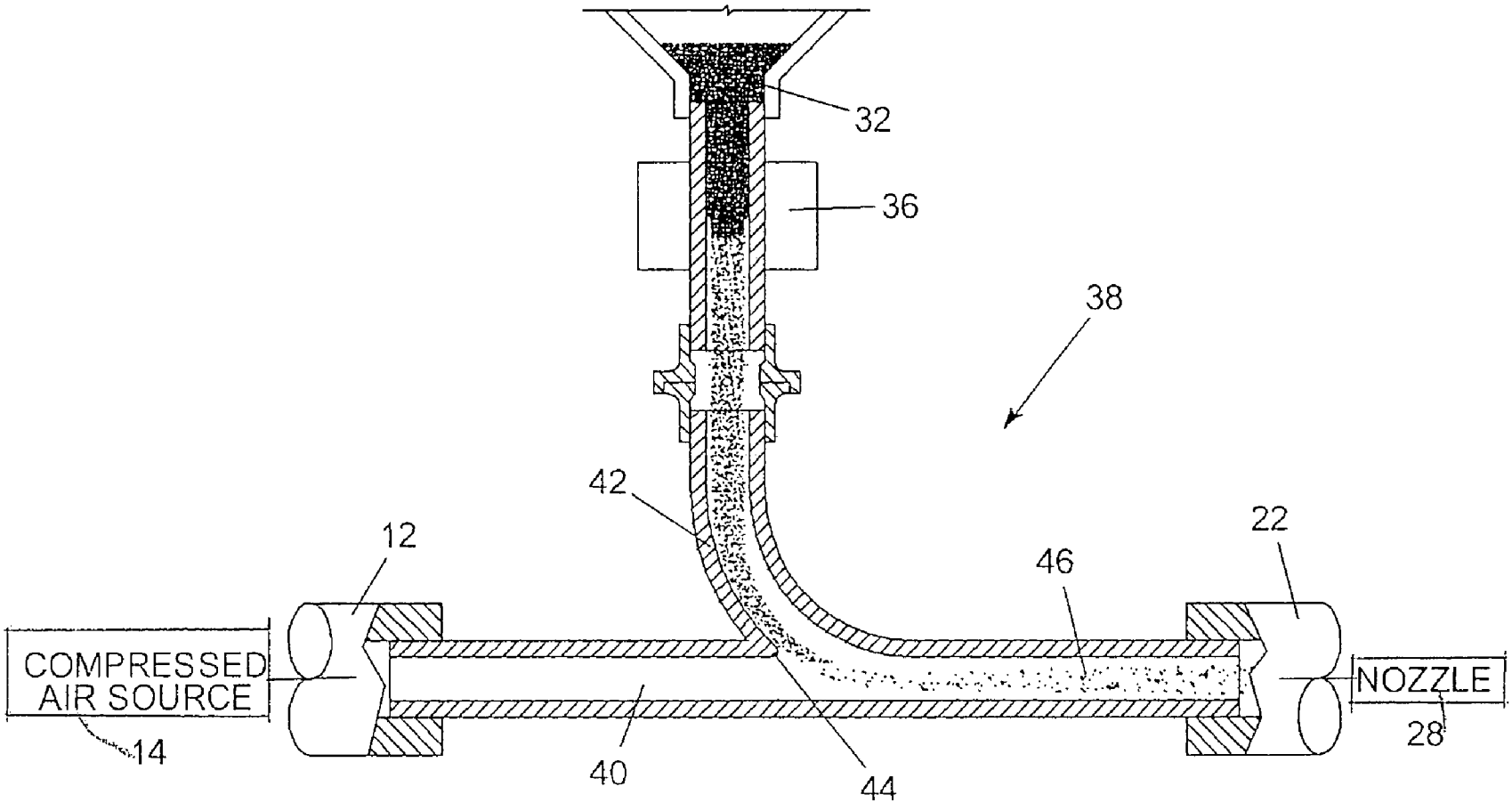
FIG. 2 is a cross sectional view of a device made pursuant to the teachings of the present invention.

Consistent flow of media to the nozzle 28 can only be maintained if substantially laminar flow is maintained in the mixing chamber and through the blast hose to the nozzle. Therefore, according to the invention, and referring to FIG. 2, the mixing chamber 16 of the prior art is replaced by mixing chamber 38 of the invention. Mixing chamber 38 includes a relatively long inlet portion 40, which is sufficiently long that laminal flow is established and maintained. It has been found that the length of the inlet portion 40 between the left end thereof (viewing FIG. 2) and the junction 44 with the dispensing stem portion 42 must be at least about ten times the diameter of the inlet portion 40 to assure that consistent laminar flow is established and maintained.

Mixing chamber 38 further includes an outlet portion 46 that extends from the curved dispensing stem portion 42 and engages the blast hose 22. The dispensing stem portion 42 curves from a generally vertical orientation into which media from the hopper 26 drops by gravity to an orientation generally oblique to the flow path defined between in supply and blast hoses by the mixing chamber 38. Accordingly, media, instead of being dropped vertically into the mixing chamber as in the prior art illustrated in FIG. 1, is introduced obliquely with respect to the flow stream. Accordingly, the media more easily mixes with the flow stream and is less likely to drop out of the flow stream and accumulate in the mixing chamber, also as illustrated in FIG. 1. By introducing the media obliquely, less disruption of the flow stream occurs, thus further assuring that flow through the mixing chamber remains laminar.

Figure 3:
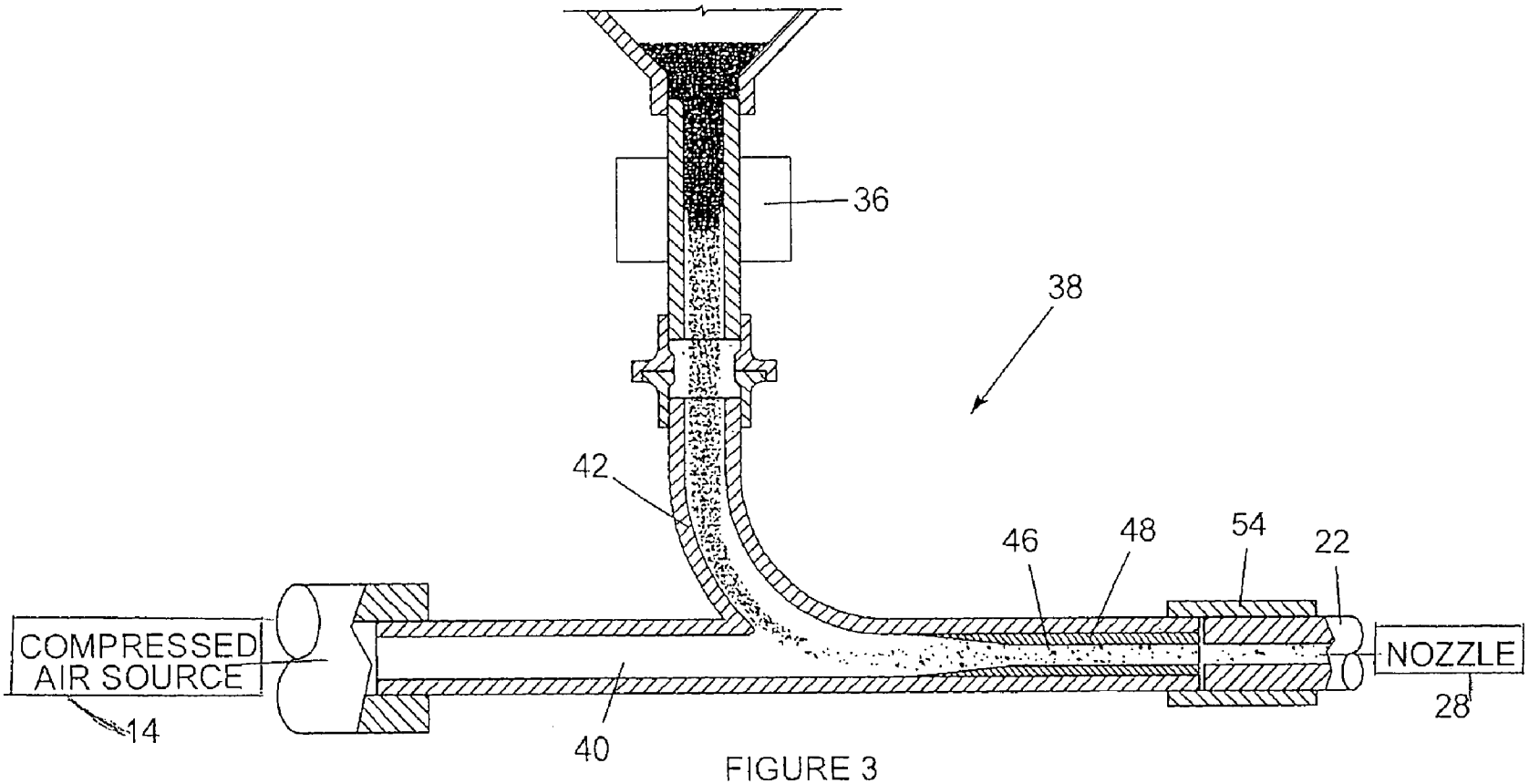
FIG. 3 is a view similar to FIG. 2 but showing another embodiment of the present device.
Figure 4:
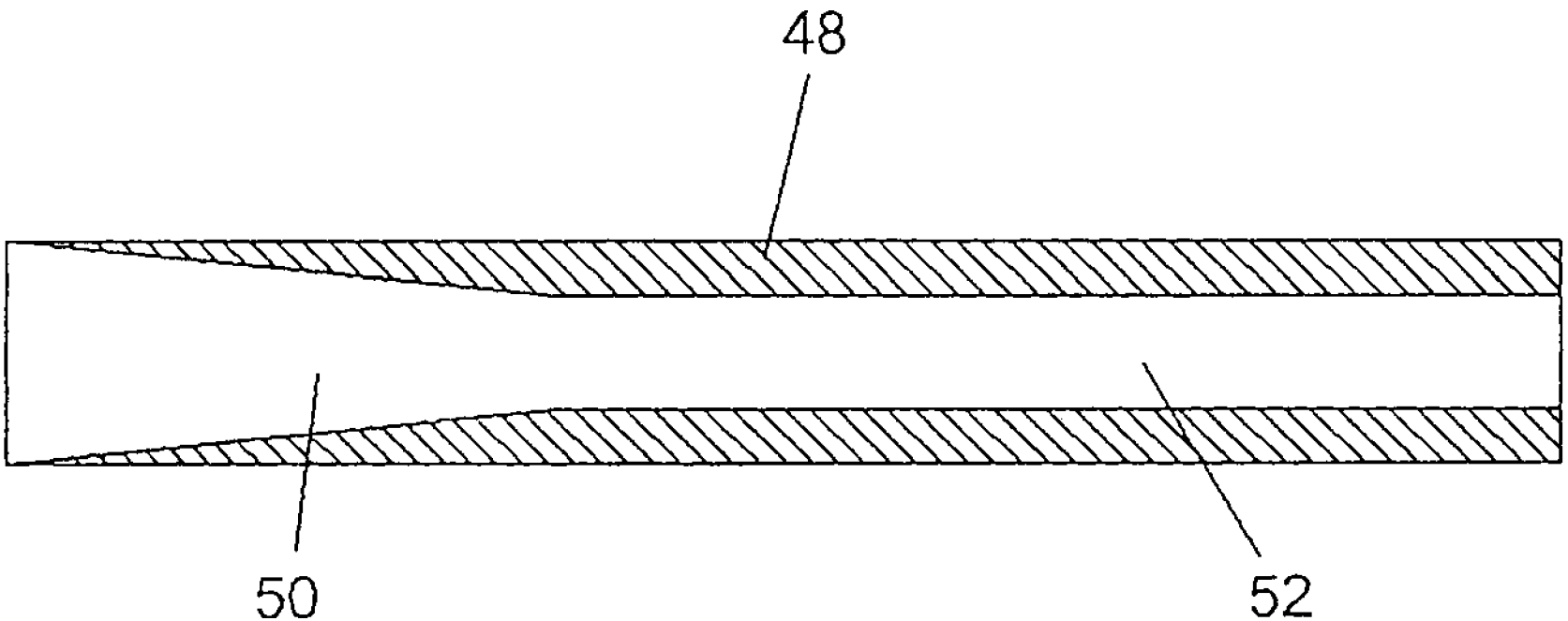
FIG. 4 is a cross sectional view of an insert used in the device illustrated in FIG. 3.

Because the flow through the mixing chamber 38 is laminar and because the media is mixed with the flow stream through the curved dispensing portion 42, the discontinuities in flow due to the turbulent flow of the prior art are minimized. However, it will be noted in FIG. 2 that a change in diameter of the flow path does occur between the outlet portion 46 and the blast hose 22. Accordingly, as shown in FIG. 3, to eliminate this change in diameter and any turbulence introduced thereby, an insert 48 (which is shown in detail in FIG. 4) is installed in the outlet portion 46 of the mixing chamber 38. The insert 48 includes a tapered section 50 which has an initial diameter substantially equal to the inner diameter of the outlet portion 46 and tapers inwardly, terminating in a constant diameter portion 52. The diameter of the constant diameter portion 52 is substantially the same as the inner diameter of the blast hose 22, which is attached to the outlet portion 46 by a sleeve 54, so that the inner diameter of the blast hose 22 is maintained in registry with the constant diameter portion 52 of the insert 48. Accordingly, since all abrupt changes in diameter have been eliminated, laminar flow, once established in the relatively long inlet portion 40 of mixing chamber 38, is maintained through the mixing zone where media is dropping through curved dispensing portion 42 is mixed with the flow stream, through the outlet portion 46, and into the blast hose 22.

The invention claimed is:

1. Media transport device for transporting media from a storage hopper to a workpiece comprising a source of compressed air, a supply hose connecting the compressed air source to a mixing chamber, a blast hose connecting the mixing chamber to a nozzle dispensing the media onto the workpiece, said mixing chamber defining a flow path for the compressed air between the supply hose and the blast hose and including an inlet portion connected to the supply hose, an outlet portion connected to the blast hose, and a curved dispensing portion connected with said storage hopper, said curved dispensing portion curving obliquely into said flow path from an orientation generally transverse to said flow path, whereby said curved dispensing porion curves from an orientation permitting media within the storage hopper to drop into and travel through said curved dispensing portion into said flow path until discharged from the curved dispensing portion into said flow path at an oblique angle with respect to the flow path to introduce media from the storage hopper into the flow path at an oblique angle with respect thereto whereby turbulence of compressed air communicated through said flow path caused by media introduced into the flow path is minimized.

2. Media transport device as claimed in claim 1, wherein said inlet portion has a length sufficient to assure laminar flow of compressed air through the inlet portion.

3. Media transport device as claimed in claim 2, wherein the length of the inlet portion is significantly longer than the diameter of the inlet portion.

4. Media transport device as claimed in claim 2, wherein the length of the inlet portion is at least about ten times the diameter of the inlet portion.

5. Media transport device as claimed in claim 1, wherein said outlet portion includes a tapered section terminating in a diameter substantially equal to the inner diameter of the blast hose.

6. Media transport device as claimed in claim 5, wherein said tapered section is defined on an insert mounted in the outlet portion.

7. Media transport device as claimed in claim 6, wherein the insert includes said tapered section and a constant diameter section extending from the tapered section to said blast hose.

8. Media transport device as claimed in claim 5, wherein said tapered section registers with a constant diameter section, the diameter of said constant diameter section being substantially equal to the inner diameter of said blast hose.

9. Media transport device for transporting media from a storage hopper to a workpiece comprising a source of compressed air, a supply hose connecting the compressed air source to a mixing chamber, a blast hose connecting the mixing chamber to a nozzle dispensing the media onto the workpiece, said mixing chamber defining a flow path for the compressed air between the supply hose and the blast hose and including an inlet portion connected to the supply hose, an outlet portion connected to the blast hose, and a curved dispensing portion conveying media from said storage hopper into said flow path, said inlet portion being of sufficient length to assure laminar flow of compressed air through the mixing chamber before the media is introduced into the flow stream, said curved dispensing portion terminating at said mixing chamber for introducing said media obliquely with respect to said flow path so that the laminar flow through the mixing chamber is maintained.

10. Media transport device as claimed in claim 9, wherein the length of the inlet portion is significantly longer than the diameter of the inlet portion.

11. Media transport device as claimed in claim 10, wherein the length of the inlet portion is at least about ten times the diameter of the inlet portion.

12. Media transport device as claimed in claim 9, wherein said outlet portion includes a tapered section terminating in a diameter substantially equal to the inner diameter of the blast hose, whereby laminar flow is maintained through said outlet section and into said blast hose.

13. Media transport device as claimed in claim 12, wherein said tapered section registers with a constant diameter section, the diameter of said constant diameter section being substantially equal to the inner diameter of said blast hose.

14. Media transport device for transporting media from a storage hopper to a workpiece comprising a source of compressed air, a supply hose connecting the compressed air source to a mixing chamber, a blast hose connecting the mixing chamber to a nozzle dispensing the media onto the workpiece, said mixing chamber defining a flow path for the compressed air between the supply hose and the blast hose and including an inlet portion connected to the supply hose, an outlet portion connected to the blast hose, and a curved dispensing portion terminating at said mixing chamber conveying media from said storage hopper into said flow path, said inlet portion being of sufficient length to assure laminar flow of compressed air through the mixing chamber before the media is introduced into the flow stream, said outlet portion including a tapered section terminating in a diameter substantially equal to the inner diameter of the blast hose, whereby laminar flow is maintained through said outlet section and into said blast hose, and whereby turbulence of compressed air communicated through said flow path caused by media introduced into the flow path is minimized.

15. Media transport device as claimed in claim 14, wherein said tapered section registers with a constant diameter section, the diameter of said constant diameter section being substantially equal to the inner diameter of said blast hose.

16. Media transport device as claimed in claim 14, wherein said dispensing portion curves from a generally vertical orientation permitting media to drop from said storage hopper into the dispensing portion to an orientation disposed oblique to said flow path whereby media is dispensed into said flow stream obliquely thereto to thereby maintain substantially laminar flow through the mixing chamber.

* * * * *